US009931531B2

(12) United States Patent
Robinson et al.

(10) Patent No.: US 9,931,531 B2
(45) Date of Patent: Apr. 3, 2018

(54) WEIGHTED EXERCISE VEST

(71) Applicants: Chantel Robinson, Laurence Harbor, NJ (US); Howard Allen Wilson, IV, Campbell, CA (US)

(72) Inventors: Chantel Robinson, Laurence Harbor, NJ (US); Howard Allen Wilson, IV, Campbell, CA (US)

( * ) Notice: Subject to any disclaimer, the term of this patent is extended or adjusted under 35 U.S.C. 154(b) by 49 days.

(21) Appl. No.: 15/087,900

(22) Filed: Mar. 31, 2016

(65) Prior Publication Data

US 2016/0287924 A1 Oct. 6, 2016

Related U.S. Application Data

(60) Provisional application No. 62/140,966, filed on Mar. 31, 2015.

(51) Int. Cl.

| | |
|---|---|
| ***A63B 21/065*** | (2006.01) |
| ***A63B 21/00*** | (2006.01) |
| *A63B 69/00* | (2006.01) |
| *A63B 21/072* | (2006.01) |
| *A63B 21/075* | (2006.01) |

(Continued)

(52) U.S. Cl.

CPC ..... *A63B 21/065* (2013.01); *A63B 21/0004* (2013.01); *A63B 21/00065* (2013.01); *A63B 21/4007* (2015.10); *A63B 21/0607* (2013.01); *A63B 21/075* (2013.01); *A63B 21/0724* (2013.01); *A63B 21/4005* (2015.10); *A63B 69/0028* (2013.01); *A63B 69/0048* (2013.01); *A63B 2071/0063* (2013.01); *A63B 2209/00* (2013.01); *A63B 2209/02* (2013.01); *A63B 2209/10* (2013.01); *A63B 2225/09* (2013.01); *A63B 2225/687* (2013.01)

(58) Field of Classification Search

CPC ..... A63B 21/065; A63B 21/00065; A63B 21/0607; A63B 21/4005; A63B 21/4007; A63B 21/075; A63B 21/4039; A63B 21/4009; A63B 21/4001; A63B 21/40; A63B 21/4023; A63B 2225/687; A63B 69/0028; A63B 69/0048; A63B 2209/02

USPC ..... 2/102, 455, 461, 462

See application file for complete search history.

(56) References Cited

U.S. PATENT DOCUMENTS

| | | | |
|---|---|---|---|
| 1,047,212 | A | 12/1912 | Hamilton |
| 3,322,425 | A | 5/1967 | Moore |

(Continued)

*Primary Examiner* — Gregory Winter

(74) *Attorney, Agent, or Firm* — Christopher Peil; Law Office of Christopher Peil

(57) ABSTRACT

A weighted vest includes weight attachment points that allow the user to customize the weight distribution when attaching resistance across a body surface. The vest is secured with shoulder straps, side support straps and a chest buckle and can be comfortably worn during any form of physical exercise, freeing the user's hands for other purposes. The vest is reinforced to withstand the stress of the added resistance with the interior of the vest being padded for comfort. Exchangeable rubber disks are removeably fastened to a back panel to modify the resistance in order to achieve the desired exercise intensity. The disks are shaped to fit together to form a continuous, tessellated layer, if desired, and are secured to attachment points on the weight panel with fasteners. The rubber disks are weighted to provide added mass with sufficient flexibility to conform to contours of the user's body.

11 Claims, 8 Drawing Sheets

(51) Int. Cl.
*A63B 21/06* (2006.01)
*A63B 71/00* (2006.01)

(56) References Cited

U.S. PATENT DOCUMENTS 4,272,847 A * 6/1981 Buhler ..... A63B 71/12 2/461
4,332,379 A 6/1982 Bannister
4,344,620 A 8/1982 Debski
4,382,302 A * 5/1983 Watson ..... A63B 21/065 2/102
4,602,387 A 7/1986 Zakrzewski
4,658,442 A * 4/1987 Tomlinson ..... A63B 21/065 2/102
4,944,509 A 7/1990 Snider
4,948,122 A 8/1990 Andrews, Sr.
4,989,267 A * 2/1991 Watson ..... A63B 21/065 2/102
5,131,576 A 7/1992 Turnipseed
5,167,600 A 12/1992 Baird
5,294,129 A * 3/1994 Brown ..... A63B 59/20 273/343
5,299,999 A 4/1994 Brine
5,417,635 A 5/1995 Sell
5,588,940 A 12/1996 Price et al.
6,149,557 A * 11/2000 Williams ..... A63B 21/06 482/105
6,209,135 B1 * 4/2001 Irvin ..... A63B 21/0603 2/102
6,669,608 B1 * 12/2003 Winston ..... A63B 21/4007 2/102
6,675,391 B2 1/2004 Morrison
7,200,871 B1 * 4/2007 Carlson ..... A41D 13/0012 2/102
7,326,154 B2 2/2008 Foley
7,490,361 B1 * 2/2009 Floyd ..... A41D 13/0512 2/94
8,062,194 B2 11/2011 Weiss
2003/0101508 A1 * 6/2003 Marshall ..... A41D 13/0012 2/462
2005/0188450 A1 * 9/2005 Clark ..... A41D 13/1209 2/247
2011/0167533 A1 * 7/2011 Stewart ..... A63B 21/0601 2/102
2012/0289385 A1 * 11/2012 Marji ..... A63B 21/065 482/105
2013/0190144 A1 * 7/2013 Ross ..... A63B 21/0603 482/105
2016/0367848 A1 * 12/2016 Seuk ..... A63B 21/065

* cited by examiner

WEIGHTED EXERCISE VEST

CROSS REFERENCE TO RELATED APPLICATION

This application claims benefit of U.S. provisional patent application Ser. No. 62/140,966, filed Mar. 31, 2015, the entirety of which is incorporated herein by this reference thereto.

BACKGROUND

Technical Field

The present disclosure relates to the field of fitness and exercise equipment. More particularly, the present disclosure relates to a weighted exercise vest.

Background Information

Manufacturers of athletic and fitness equipment, in designing their products, tend to design for the male population, perhaps because of a lingering perception that athletic activities and fitness are mostly something with which the male population is concerned. Thus, fitness equipment tends to be scaled and proportioned to the male physique. The design features of such fitness equipment embody a masculine aesthetic and thus, such equipment may be difficult for female athletes to use and enjoy. While exercise vests that accommodate the female anatomical form are available, they are provided only in predetermined weights. They do not allow the user to vary the amount of resistance added by the vest. Weighted vests having pockets for receiving weights are known. However, such exercise vests for adding body-worn resistance are generally scaled and proportioned to the male physique, rendering them cumbersome and uncomfortable for women to wear. Additionally, such vests may be suitable for strict, controlled movements such as pull-ups or push-ups, but they hamper more dynamic movement such as running or sport or field activities such as tennis and softball.

SUMMARY

A weighted vest includes weight attachment devices that allow the user to customize the weight distribution when attaching resistance across a body surface. The vest is secured with shoulder straps, side support straps and a chest buckle and can be comfortably worn during any form of physical exercise, freeing the user's hands for other purposes. The vest is reinforced to withstand the stress of the added resistance with the interior of the vest being padded for comfort. Exchangeable rubber disks are removeably fastened to a back panel to modify the resistance in order to achieve the desired exercise intensity. The disks are shaped to fit together to form a continuous, tessellated layer, if desired, and are secured to attachment devices on the weight panel with fasteners. The rubber disks are weighted to provide added mass with sufficient flexibility to conform to contours of the user's body.

DETAILED DESCRIPTION

A weighted vest includes weight attachment points that allow the user to customize the weight distribution when attaching resistance across a body surface. The vest is secured with shoulder straps, side support straps and a chest buckle and can be comfortably worn during any form of physical exercise, freeing the user's hands for other purposes. The vest is reinforced to withstand the stress of the added resistance with the interior of the vest being padded for comfort. Exchangeable rubber disks are removeably fastened to a back panel to modify the resistance in order to achieve the desired exercise intensity. The disks are shaped to fit together to form a continuous, tessellated layer, if desired, and are secured to attachment points on the weight panel with fasteners. The rubber disks are weighted to provide added mass with sufficient flexibility to conform to contours of the user's body.

Figure 1:
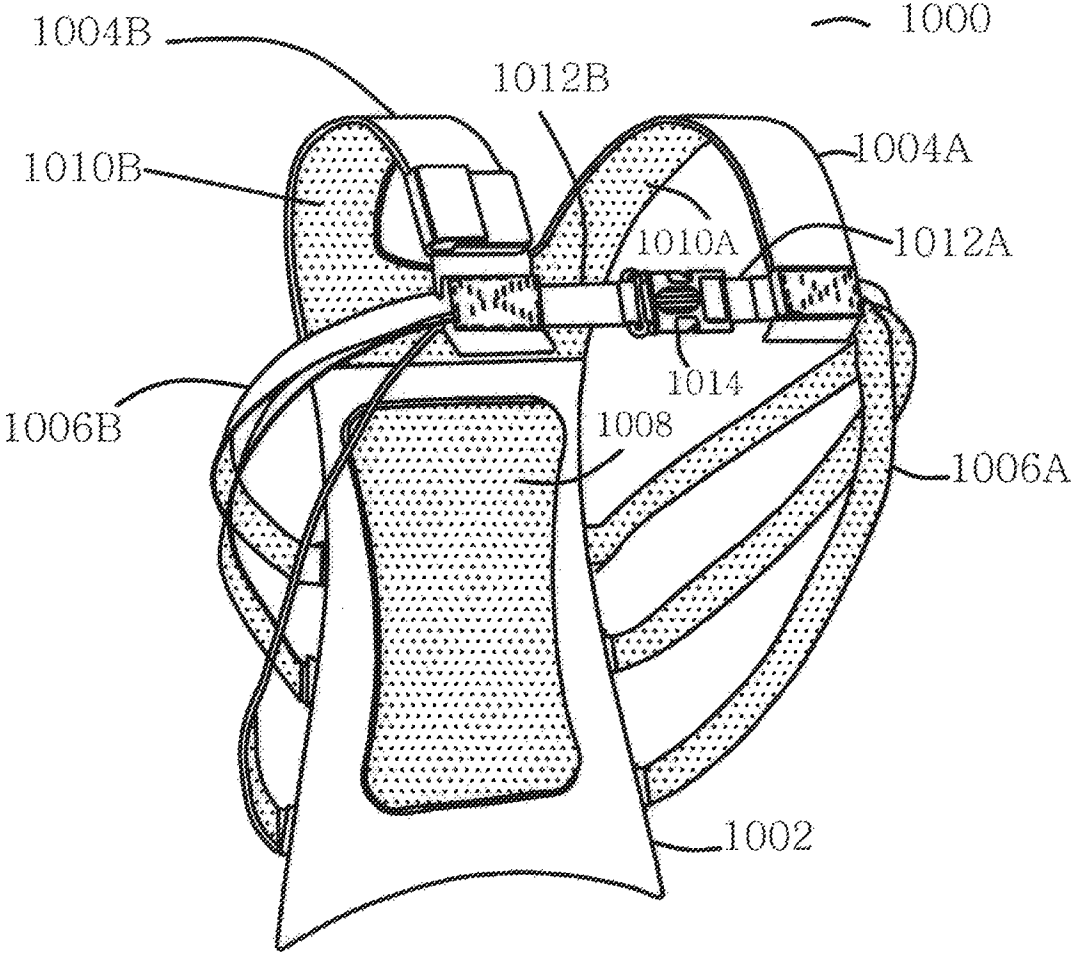
FIG. 1 provides a front isometric view of a weighted exercise vest.

Turning now to FIG. 1, a front isometric view of a weighted vest 1000 is shown. A geometric configuration and a three-dimensional curvature allow the vest to conform comfortably to the shape of the user's back, allowing for secure placement of weighted rubber disks which remain flat against the vest for distribution of the weight on the vest.

Embodiments of the vest may be tailored specifically for women as a solution to the dearth of fitness and athletic gear specifically adapted for the female population. Embodiments of the vest may also be targeted to a male user population.

In embodiments, the vest 1000 may include a back 1002 which rests on and covers the back of the user. In embodiments, the back 1002 may be contoured to approximate the silhouette of the user's torso to provide wearing comfort for the user. For example, as shown in FIG. 1, the top portion of the back 1002 is narrow relative to the bottom portion to mirror the relatively narrow upper torso of a female user. Continuous with the relatively narrow upper portion is a wider lower portion to reflect the typical female physique, which widens as the torso converges with the hips. Additional embodiments are possible in which the back is shaped and dimensioned to mirror the silhouette of a typically male physique.

The vest 1000 may further include shoulder straps 1004 *a, b*, which rest on the user's shoulders, extending over the shoulders toward the front of the torso to allow the entire vest 1000 to be supported by the user's upper body. The shoulder straps may be sleek and thin-walled to minimize the bulk of the vest 1000 and improve the vest's silhouette. In embodiments, the back 1002 and the shoulder straps 1004 may be continuous with each other, being formed from a single piece of the base material.

In embodiments, the back 1002 and the shoulder straps 1004 may be separate pieces which are fastened together to form the vest 1000. The separate pieces of the back 1002 and shoulder straps may be fastened together, for example, by stitching them together, or by heat-fusing them. Other attachment methods may occur to the practitioner of ordinary skill. In embodiments, the back and shoulder straps may be fabricated from the same base material. In embodiments, the back and shoulder straps may be fabricated from different base materials.

At least portions of the interior surface of the vest may be provided with padding 1008, 1010, to enhance the comfort of the vest 1000 and to prevent injury or irritation to the user's skin from prolonged contact with the base material of the vest. Additionally, the padding is operative to protect the user from traumatic injury as a result of falling or being accidentally hit or struck during vigorous physical activity.

As shown in FIG. 1, the back 1002 is provided with a pad 1008 on the inner surface and the upper back and shoulder straps have discrete pads 1010 *a, b* on their inner surfaces. In embodiments, the entire interior surface of the vest may be padded. The padding may be fabricated with a polymeric material such as high-density foam. Alternatively, the padding may be a quilted material such as batting, in some embodiments, having a stitched or fused or quilted fabric cover.

In embodiments, the padding may be fabricated from a breathable material such as air flow mesh that allows air circulation between the inside of the vest and the user's skin surface to minimize perspiration and provide a comfortable wearing experience.

Other materials that maintain a margin of comfort between the vest and the user's skin surface may be suitable for the padding.

In embodiments, the vest 1000 may be constructed from material such as a sheet polymer that is flexible enough to conform to the contours of the user's torso during use, but retains its original shape when not in use. For example, the vest 1000 may be fabricated from a shape-memory polymer that retains its stored shape at normal room temperature but conforms to the user's torso when exposed to the user's body temperature, and, finally, resumes its stored shape when exposed again to normal room temperature.

In embodiments, the vest may be constructed from a durable polymer fabric, such as CORDURA (INVISTA, Wichita Kans.) or GORE-TEX (W.L. GORE & ASSOCIATES, Newark Del.).

In embodiments, the vest 1000 may be constructed from a variety of materials derived from natural sources, such as canvas or leather, which provide breathability, comfort and flexibility and are able to withstand the stresses secondary to supporting the attached weights during prolonged periods of strenuous activity.

In embodiments, the vest 1000 may include a plurality of torso support straps 1006*a*, which create a secure fit and pull the weighted vest tightly against the back. As shown in FIG. 1, in an embodiment, three torso support straps 1006 are provided on each side of the back 1002. As shown, one end of each torso support strap is attached at an edge of the back, with a first of the torso support straps being attached at an edge close to the bottom of the back 1002, a third of the torso support straps being attached to outside edge in the region of the use's mid-back. In embodiments, the second torso support strap is attached to the edge of the back at a point approximately mid-way between the first and third torso support straps. The number of torso support straps and their exact placement may vary. Thus, the foregoing description of the torso support straps is not intended to be limiting.

Figure 2:
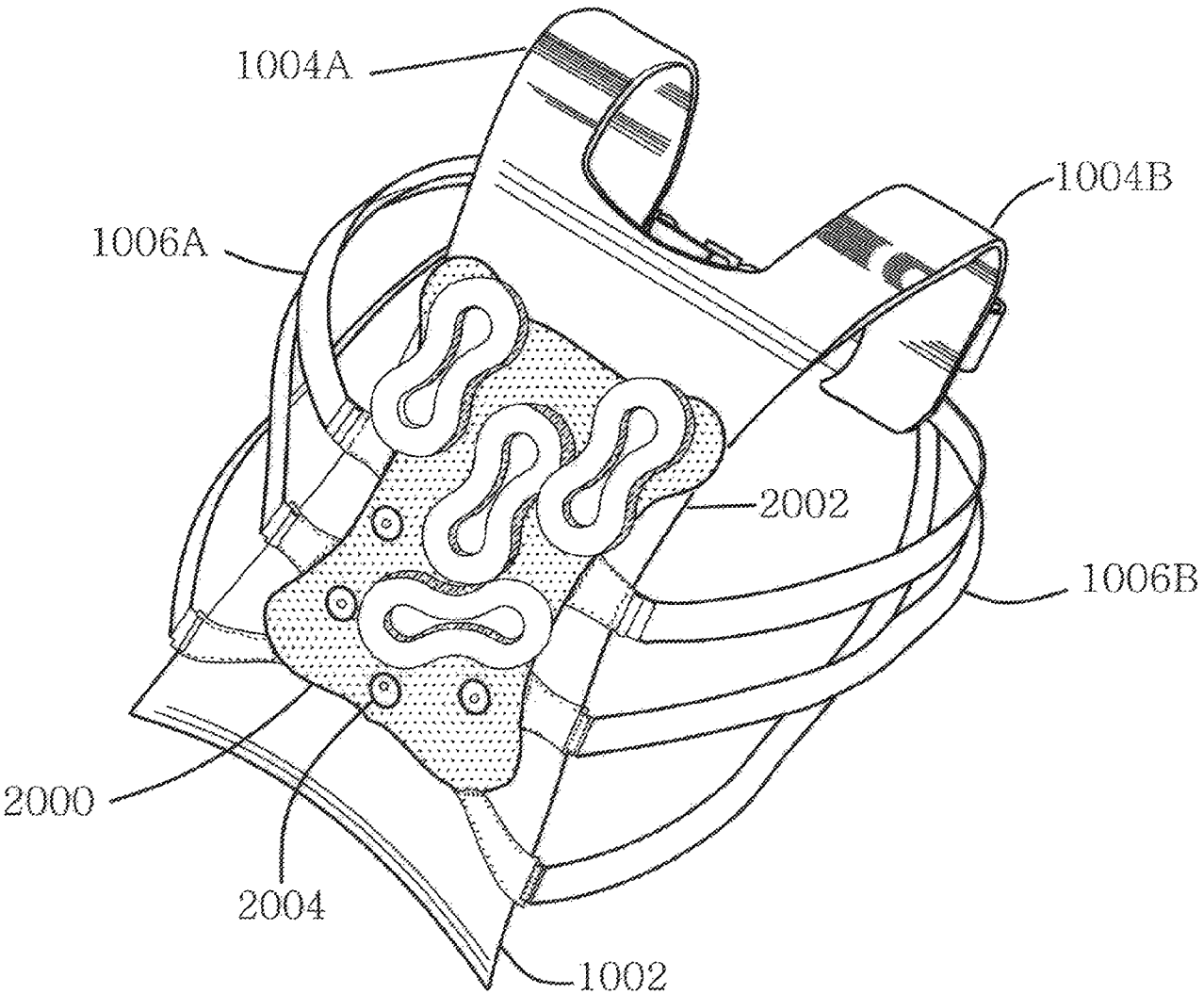
FIG. 2 provides a rear isometric view of the weighted exercise vest of FIG. 1.

As shown in FIG. 2, the torso support straps may be attached to a weight pad 2000 adhered to the back 1002 of the vest 1000. In embodiments, the torso support straps are elastic, thus having the ability to automatically conform to a user's shape and size. In embodiments, each torso support strap 1006 may attach to the pad 2000 by means of an adjustable fastener such as a strap adjuster or a side-release buckle, the adjustable fastener itself being attached to the pad 2000. By providing an adjustable fastener, the torso support straps can be loosened and tightened to exactly adjust the fit of the vest 1000 to an individual user. In embodiments, the torso support straps may be fixedly attached to the weight pad 2000 by means of stitches, rivets or other fasteners.

In embodiments, the weight pad 2000 may be fabricated from a flexible material such as NEOPRENE (DUPONT, Wilmington Del.), natural rubber, silicon rubber or various types of high-density foam, having sufficient flexibility to conform to the contours of the user's body during use, but sufficient hardness and thickness to provide robust support for the weights attached to it.

As shown in FIG. 1, the remaining end of each of the torso support straps is attached at a distal end of a shoulder strap 1004. In embodiments, the three torso support straps attached to a single side of the back 1002 all converge on a common attachment point at a distal portion of the shoulder strap 1004 on the same side of the vest 1000. The torso support straps on the remaining side of the vest converge on a corresponding attachment point on the distal portion of the remaining shoulder strap 1004.

The vest 1000 may further include a chest strap 1012 that fastens approximately at the level of the user's sternum by means of a buckle 1014. More will be said about the buckle herein below. The two ends 1012 *a, b* of the chest strap may also attach to the distal portion of the respective shoulder strap 1004*a, b*. Because the chest strap 1012, the buckle 1014 and the attachment points of torso support straps 1006 are co-linear, fastening the chest strap 1012 by fastening the buckle 1014 creates a tension that is translated to the torso support straps. Thus, fastening the chest strap 1012 may have the effect of tightening the torso support straps 1006 around the user's torso, so that the vest fits the user comfortably and securely. Furthermore, the chest strap 1012, by means of the buckle 1014 can be adjusted, thereby providing another point of adjustment to fit the vest to the individual user. The vest 1000 universally fits and adjusts to different body types.

In embodiments, the chest strap 1012 and the torso support straps 1006 may be fabricated from a material such as a polyester or nylon mesh The vest 1000 may include a dedicated accessory pouch 1016 in which the user may carry such personal items as a set of keys or a credit card. As shown, the accessory pouch may be attached to one of the shoulder straps. The accessory pouch may be secured, for example with a closure made from hook-and-loop tape. In embodiments, the accessory pouch 1016 may be fabricated from materials to those used for the main body of the vest and straps.

Figure 3C:
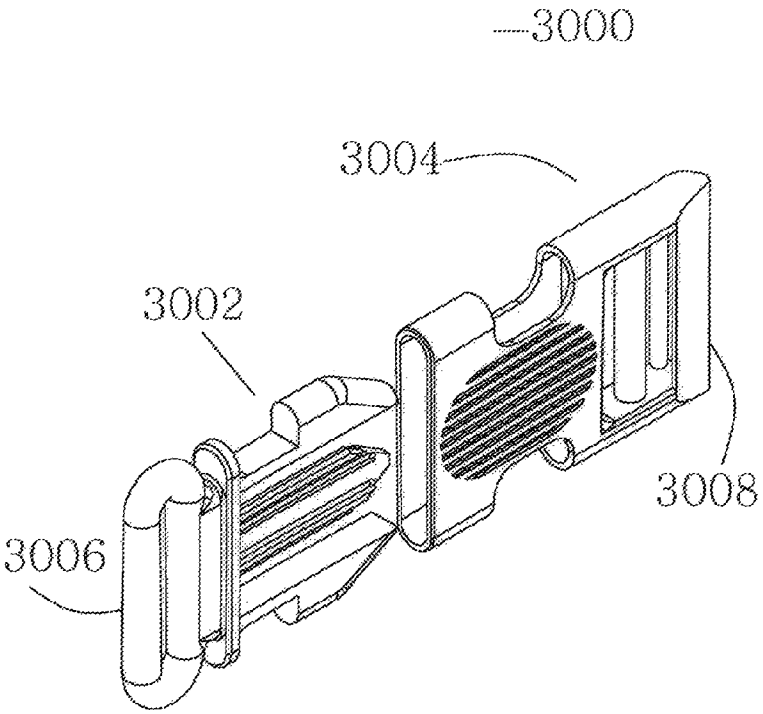
FIGS. 3*a-c* provide views of a chest buckle from the vest of FIG. 1.
Figure 3A:
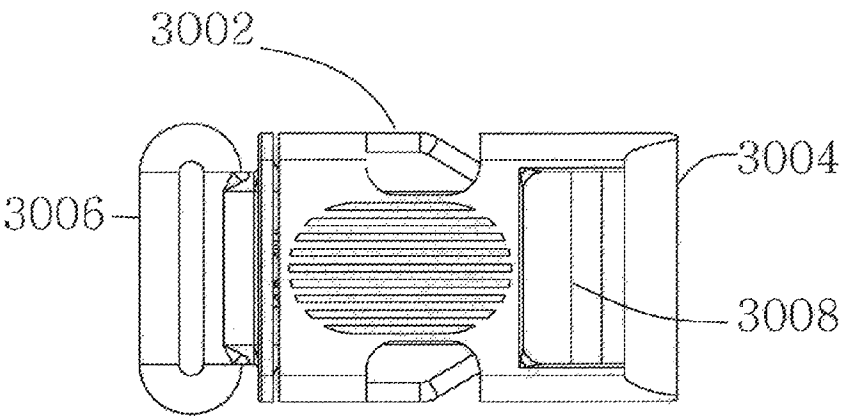
Figure 3B:
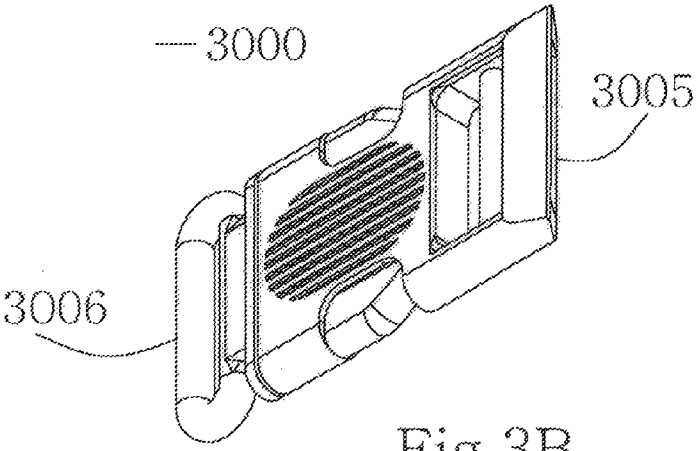

FIGS. 3*a-c* provide different views of a buckle 1014 with which the chest strap 1012*a, b* may be fastened. In embodiments, the buckle may be a side-release buckle 3000 having a hook end 3002 and a catch end 3004. As shown, the side-release buckle 3000 may be a single-adjust buckle in which one end of the chest strap 1012 is received by a strap adjustor 3008 and the remaining end is fixedly attached to the side-release buckle 3000 by means of a strap holder 3006. In embodiments, the side-release buckle 3000 may be a double-adjust buckle in which both ends of the chest strap are received by a strap adjustor, allowing the user two adjustment points to modify the length of the chest strap 1012.

During use, the side-release buckle 3000 may be fastened by sliding the hook end 3002 into the catch end 3004. The tabs on the sides of the hook end 3002 are caught in the side openings in the catch end 3004. The user may release the side-release buckle 3000 by depressing the tabs on the side of hook end 3002 and withdrawing the hook end 3002 from the catch end 3004. Other adjustable fasteners may occur to the ordinarily-skilled practitioner.

Figure 4:
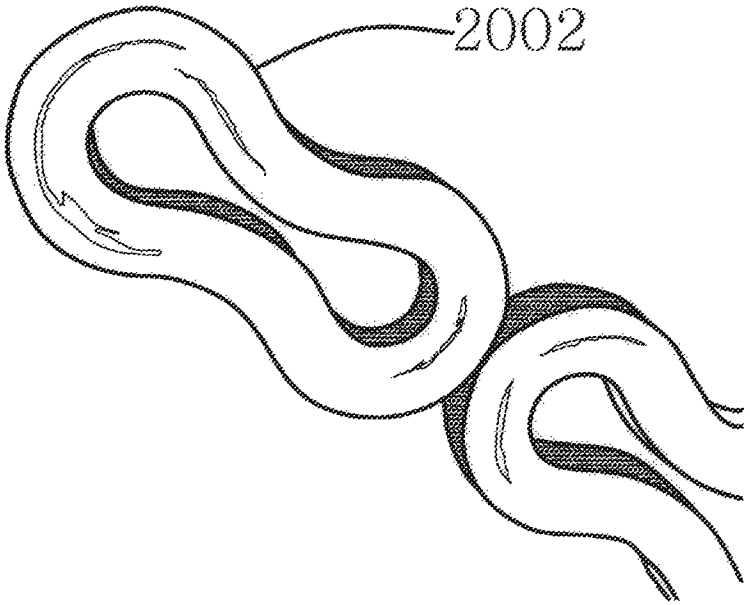
FIG. 4 provides a top view of a weighted rubber disk.
Figure 8:
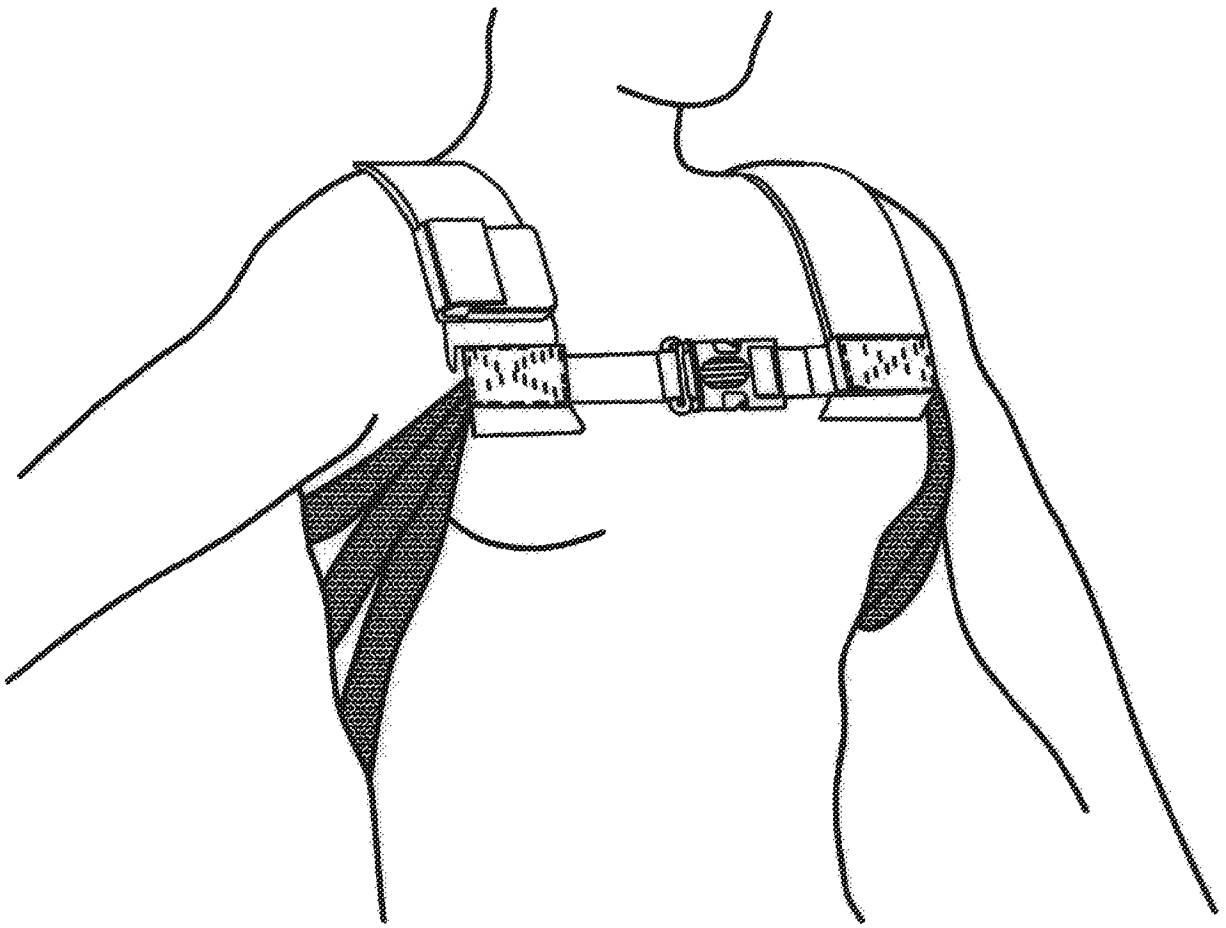
FIG. 8 shows a weighted exercise vest in use.

In embodiments, weights 2002 may be attached to the vest 1000 in multiple configurations according to what muscles the user would like to target. If desired, the user may attach the weights in a continuous, tessellated layer. In embodiments, the weights may be weighted rubber disks having an hourglass or "figure-8" shape, as shown in FIG. 4. Besides the shape shown, the weights may assume any form that tessellates within a hexagonal grid. In embodiments, the weights are provided in weights of 1 to 3 pounds for each individual weight.

Figure 5:
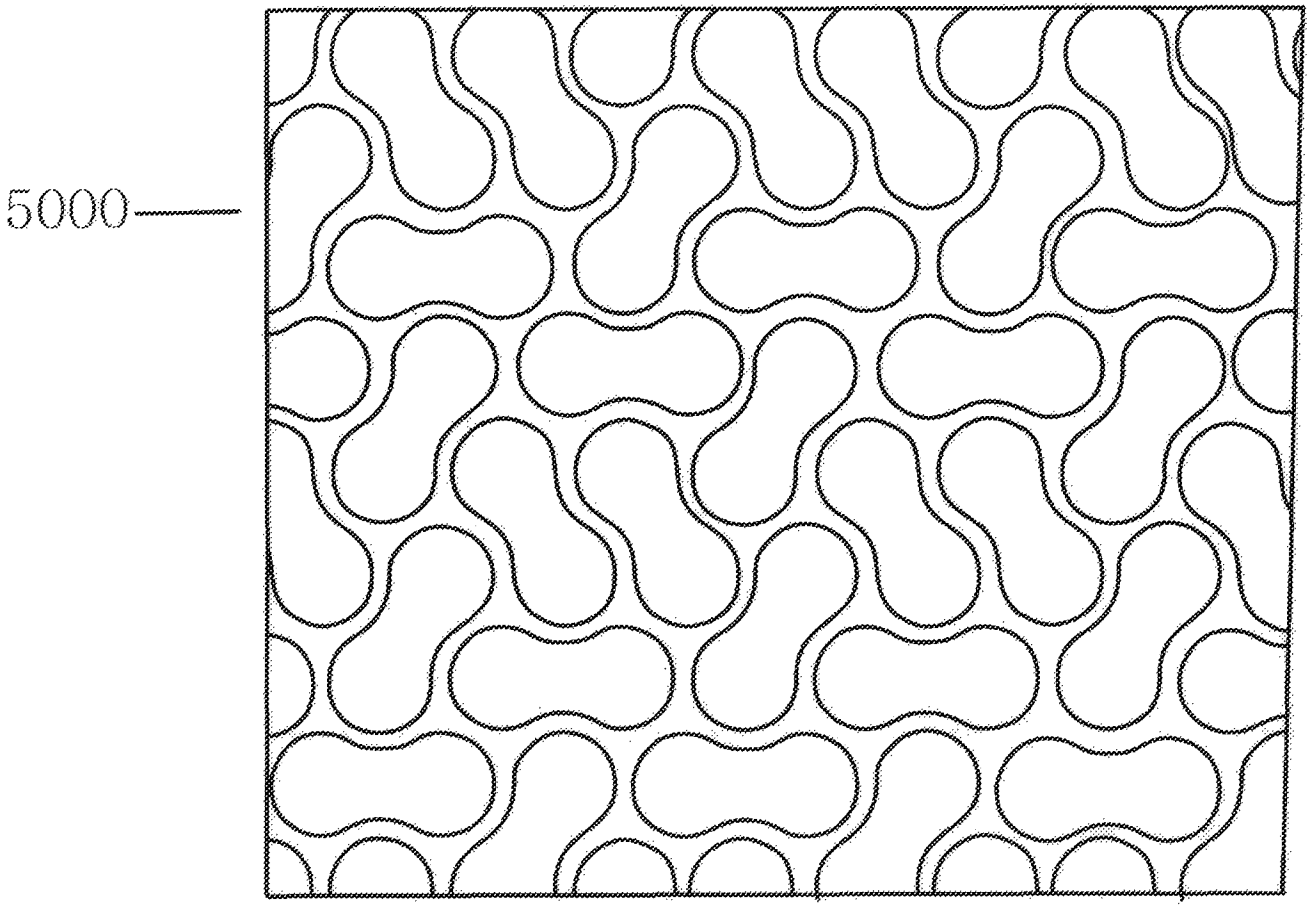
FIG. 5 shows an exemplary arrangement of weighted rubber disks.

Referring again to FIG. 2, the weight pad may include a matrix of weight-attachment devices 2004, which allows a user to customize distribution when attaching soft-rubber weights across the back, thus the weighted vest 1000 can increase effectiveness of an exercise session by allowing the user to easily modify the resistance provided to the user's core in increments. In embodiments, the weight attachment devices may be disposed in a hexagonal grid. The disposition of the attachment devices 2004 in the hexagonal grid allows properly configured weights to be attached to the vest in a tessellated arrangement without leaving spaces between the weights, as shown in FIG. 5.

Figure 6:
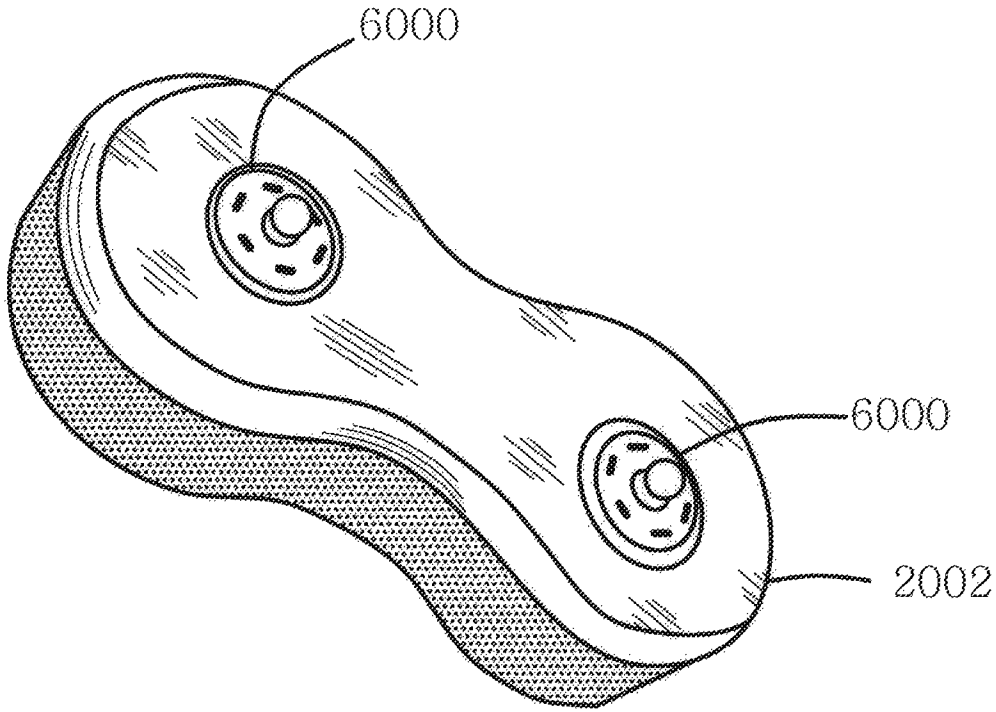
FIG. 6 provides a bottom view of a the weighted rubber disk from FIG. 4.
Figure 7:
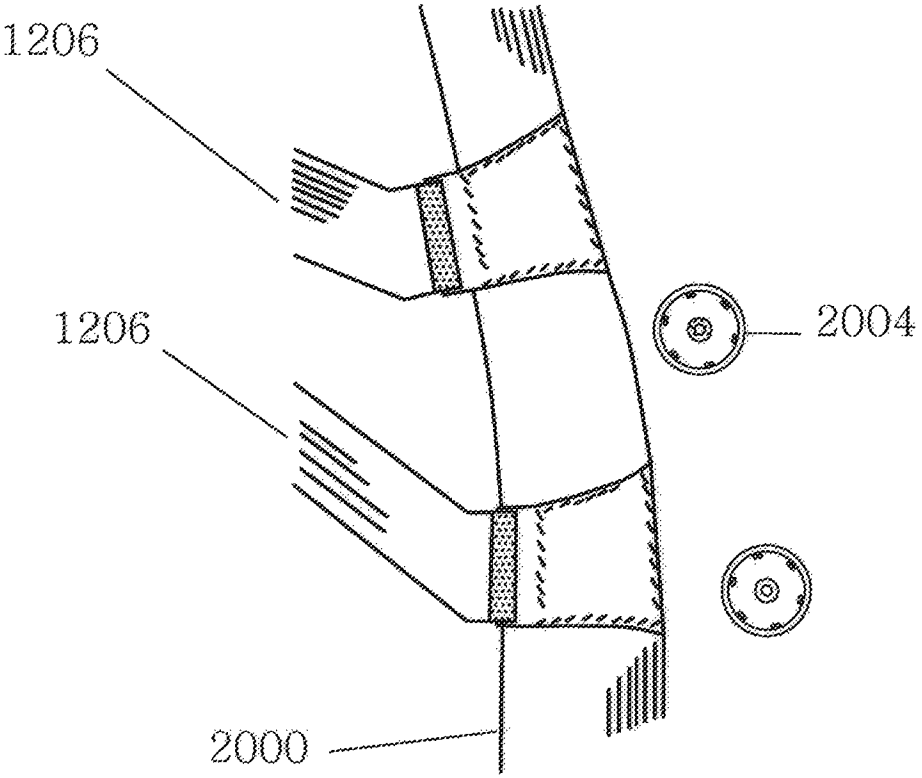
FIG. 7 provides a detailed view of a disk attachment device on the vest of FIG. 1.

In embodiments, the attachment device 2004 shown in FIG. 2 may be the receiver portion of a heavy-duty snap. The snap receiver portion 2004 is shown in greater detail in FIG. 7. As described herein below, the snap receiver portion 2004 is configured to receive studs 6000 (shown in FIG. 6) protruding from the back surface of the weights 2002. In embodiments, the studs are continuous with the main body of the weight 2002. In embodiments, the studs 6000 are permanently mounted on the rear surface of the weight 2002

In embodiments, the snap receiver portion 2004 is fixedly mounted on the outer-facing surface of the weight pad 2000, using, for example, adhesives, rivets or through the provision of legs on the receiver portion 2000 that pierce the weight pad and fold over against the opposing surface of the weight pad. Other attachment methods may occur to the ordinarily-skilled practitioner.

To attach a weight 2002 to the vest, the user need merely position the weight over a pair of snap receiver portions 2004 and snap the weight 2002 into place on the weight panel 2000. Removal of a weight from the vest involves simply grasping the weight and unsnapping it from the snap receiver portions 2004. Thus, the weights may be easily and securely attached to and removed from the vest by hand and do not fall off during a regular workout.

In use, 1 to 3 pound weights 2002 may be strategically attached to the weight panel 2000 on the back 1002 of the vest 1000. The weights can be snapped to the vest in a tessellated, hexagonal pattern, or may be more randomly placed, according to the needs and desires of the user. In an embodiment, the weight panel 2000 may allow up to six individual weights to be attached. As weighted rubber disks are added to the weight panel 2000, the weight of the vest increases. The number of weights that can be attached to the weight panel 2000 is a matter of design choice and is not intended to be limiting.

In embodiments, the weighted disks may be steel weights encased within a thick coating of an elastomer, such as rubber. In embodiments, the weighted disks may be metal pellets embedded within a matrix formed from an elastomer such as rubber. In embodiments, the weighted disks may be fabricated from a steel powder-infused elastomer. The disks may be fabricated from recycled materials such as reclaimed steel and recycled rubber. In fact, at least 50% of the materials for the weighted exercise vest can be from recycled/reclaimed sources.

Embodiments may include a waist strap.

Embodiments may include elastics to hold the weights tightly against the body.

Embodiments may include ventilation channels in association with the weight pad 2000 to promote air circulation and dissipate body heat.

Embodiments may include a mechanism for strap management, such as clasps for securing and managing the straps.

The weighted exercise vest is an alternative to a weighted backpack that allows the user to increase resistance during walking, running, climbing, cycling, and/or exercising.

The weighted exercise vest provides a unique alternative to weighted backpacks, in which the weights are flexible, weighted rubber disks that connect to hardware located on the back and arranged in-line like a backbone or ribs.

The weighted exercise vest allows the user freedom to move her hands and arms and to use them with other exercise equipment. When exercising, users often hold hand weights or a weighted ball or use a barbell for exercising alone or in group fitness classes, exercises that require holding or securing a weighted device with the hands for additional resistance while exercising. The weighted exercise vest eliminates the use of hands/arms, thus allowing the user to add additional hand-held weight, in addition to the resistance added by the vest itself.

The weighted exercise vest provides at least the following benefits:

- good for the body and good for the environment;
- weighted fitness gear to maximize the user's workout;
- easy to put on and wear on top of exercise clothing;
- not bulky, but contoured to the body and can be worn during daily activities other than exercise;
- a supplement to a user's current workout regimen that challenges the muscles and increases the amount of calories burned by increasing resistance;
- ideal for group exercise classes; and use with exercise machines
- maximize benefit from familiar exercise by increasing resistance and thus increasing calorie-burn;
- mothers can use when strolling the baby to get a workout at the same time;
- simplifies overloading and pyramiding, causing more resistance to the user's muscles;
- benefits all fitness levels because the user controls the resistance/weight; and
- suitable for use during personal training, group training or body sculpting exercises In the foregoing specification, the present system has been described with reference to specific exemplary embodiments thereof. It will, however, be evident that various modifications and changes may be made thereto without departing from the broader spirit and scope set forth in the appended claims. The specification and drawings are, accordingly, to be regarded in an illustrative sense rather than a restrictive sense.

The invention claimed is:

1. An exercise vest comprising:

shoulder straps configured for suspending the exercise vest on a user's body;

a weight panel configured to conform to contours of a user's body during use;

a plurality of elastic torso support straps, a first end of each of said torso support straps being attached at an edge of said weight panel and a remaining end of each of said torso support straps being attached to one of said shoulder straps;

wherein said plurality of torso support straps comprises three torso support straps on each side of the vest, the first ends of each of the three torso support straps on each side of the vest being attached at the edge of said weight panel at spaced intervals and the remaining ends of each of the three torso support straps on each side of the vest being attached at a distal portion of one of said shoulder straps, the distal portion of the shoulder strap terminating at a front of the user's body in a sternal region of the user's body;

a plurality of stud receivers integrated with an outward-facing surface of the weight panel;

one or more resilient weights, a rear surface of each of said one or more resilient weights having at least one integrated stud configured to reversibly snap together with at least one of said stud receivers responsive to:

inserting said at least one stud into said at least one stud receiver, and applying manual pressure to said one or more resilient weights;

wherein said plurality of stud receivers are disposed on the outward-facing surface of said weight panel in a predetermined pattern.

2. The exercise vest of claim 1, wherein said one more resilient weights are configured to have an hourglass shape.

3. The exercise vest of claim 1, wherein said weight panel is adhered to a back of the vest and wherein the shoulder straps are integrated with the back of the exercise vest.

4. The exercise vest of claim 1, further comprising:

a chest strap, the chest strap including two ends and a buckle configured for fastening the two ends of said chest strap together to form a single strap, each end of said chest strap being attached to one of said shoulder straps, the buckle further including at least one strap adjustor for adjusting a length of at least one of the two ends of said chest strap.

5. The exercise vest of claim 4, wherein the buckle comprises a side-release buckle.

6. The exercise vest of claim 4, wherein said elastic torso straps are configured to, responsive to at least one of:

wearing the vest, adjusting a length of said chest strap, and fastening the buckle;

pull the vest to conform to the contours of the user's body and hold said weight panel in place against the user's back.

7. The exercise vest of claim 1, further comprising padding adhered to inward facing surfaces of the vest.

8. The exercise vest of claim 7, wherein said padding comprises one of:

a high-density foam; and air-flow mesh.

9. The exercise vest of claim 1, further comprising a mechanism configured for securing and managing straps.

10. The exercise vest of claim 1, wherein said vest is configured to conform to contours of the user's body during use.

11. The exercise vest of claim 1, wherein a back of the vest is shaped to approximate a silhouette of the user's torso.

* * * * *